United States Patent [19]

Mladota

[11] 4,167,914

[45] Sep. 18, 1979

[54] ROTATING ROD, ROTATING PRESS ROLL NIP COATING APPARATUS

[75] Inventor: John Mladota, Lausanne, Switzerland

[73] Assignee: Bolton-Emerson, Inc., Lawrence, Mass.

[21] Appl. No.: 800,217

[22] Filed: May 25, 1977

[51] Int. Cl.[2] ..... B05C 11/00

[52] U.S. Cl. ..... 118/33; 118/414

[58] Field of Search ..... 118/34, 118, 119, 126, 118/407, 413, 414, 410, 33

[56] References Cited

U.S. PATENT DOCUMENTS

| | | | |
|---|---|---|---|
| 2,009,631 | 7/1935 | Montgomery | 118/414 |
| 2,946,307 | 7/1960 | Warner | 118/414 X |
| 3,057,327 | 10/1962 | Faeber et al. | 118/413 |
| 3,131,092 | 4/1964 | Coghill | 118/413 |
| 3,245,377 | 4/1966 | Gettel | 118/119 |
| 3,461,837 | 8/1969 | Dreher | 118/410 X |
| 3,496,012 | 2/1970 | Biorseth | 118/414 X |
| 3,854,441 | 12/1974 | Park | 118/410 X |
| 3,919,974 | 11/1975 | Herzog | 118/419 X |

FOREIGN PATENT DOCUMENTS

| | | | |
|---|---|---|---|
| 1964908 | 8/1970 | Fed. Rep. of Germany | 118/414 |

*Primary Examiner*—Dorsey Newton

*Attorney, Agent, or Firm*—Pearson & Pearson

[57] ABSTRACT

An extrusion coater for high viscosity, thin coatings of the hot melt type, includes an elongated slot coating head across which the web to be coated is advanced under tension and includes a lead-on lip at the slot plus a fixed, unyieldable, lead-off lip having an elongated, rotatable, cylindrical rod deeply seated for about two thirds of its circumference therein and unyieldably supported on a fixed axis of rotation. A yieldably mounted, press roll with a rubber like surface forms a pressure nip with the smooth hard unyieldable surface of the rod and the rod is rotated intermittently, or continuously by power means depending on the amount of impurities in the coating media. The rod rotation is not for metering purposes but for spreading wear while overcoming any streaking.

4 Claims, 4 Drawing Figures

ROTATING ROD, ROTATING PRESS ROLL NIP COATING APPARATUS

BACKGROUND OF THE INVENTION

This invention relates to the type of extrusion coater disclosed in U.S. Pat. No. 3,854,441 to George C. Park of Dec. 17, 1974 and disclosed in U.S. Pat. No. 3,919,974 to Peter Herzog of Nov. 18, 1975. Such coaters are especially designed to handle hot melts which are highly viscous in the order of 100,000 centipoises and to coat relatively wide webs such as eighty six inches or the like. The web is advanced under predetermined lateral and longitudinal tension over the extrusion slot and the thickness of the coating is metered by the pressure of the coating supply pump.

One of the problems encountered in coating such wide widths with high viscosity coating has been the excessive wear on the lead off lip despite the fact that the lips have been specially treated by a costly process to prevent wear. Another problem encountered in any slot coating apparatus is the lodging of specks of foreign material on the lead-off lip, this causing a continuous streak in the coating applied to the web until it can be removed usually during down time which is expensive.

It has been proposed in U.S. Pat. No. 3,496,012 to Biorseth of Feb. 17, 1970 to provide an extrusion slot coating head with a feed aperture, a discharge aperture and a rotatable rod metering means. The rotatable rod has a wire wound surface and no yieldable press roll is used to form a rolling nip with the rod. The rod is actually a metering roll which can be rotated in either direction at various speeds by a motor to thereby thin or thicken the coating. The Biorseth apparatus has a coating head which creates a cavity, or fountain, of the coating material across which a web is moved and the excess coating in the fountain travels back to the supply while a layer adheres to the underside of the moving web in the thickness determined by the speed and direction of rotation of the metering rod.

In other coating devices of the prior art, a similar power driven metering roll, rotating at the downstream side of a fountain, or pool, of liquid coating has also been used to meter the thickness of coating picked up by an applicator roll, the applicator roll depositing the coating further along the path on a surface of a moving web. Exemplary of such coaters are U.S. Pat. No. 2,560,572 to Haywood of 1951 and U.S. Pat. No. 1,983,982 to Vinollenberg of 1934. As in the Biorseth device, no pressure roll, rolling nip, or pressure rolling nip is disclosed in these patents.

Endless webs carried by backing rolls through a fixed clearance nip with an applicator roll are taught in U.S. Pat. No. 3,345,377 to Gettel of 1966 and U.S. Pat. No. 3,533,833 to Takahashi of 1970 but both patents disclose doctor means in rear of the nip, the Gettel doctor means being a small diameter rod on the end of a blade.

The rotating rods disclosed in U.S. Pat. No. 2,946,307 to Warner of July 26, 1960, U.S. Pat. No. 3,461,837 to Dreher of Aug. 19, 1969, and in German Pat. No. 1,964,908 of Dec. 30, 1968, all are characterized by support mountings for the rod which provide a movable axis of rotation by means of flexible, yieldable housings and all are for doctoring purposes or to serve as longitudinal, fluid metering means as in the Biorseth patent above.

SUMMARY OF THE INVENTION

In this invention a rotatable, elongated, cylindrical rod, of small diameter, is deeply seated in a groove of corresponding shape in the lead-off lip, or edge, of the extrusion slot of a coating head. Cooperable with the rod is a rotatable, elongated, cylindrical, press roll, of larger diameter, the press roll having a rubber-like surface and being yieldable, while the rod has an unyieldable, hard and preferably smooth surface. A web to be coated is advanced, under lateral and longitudinal tension of suitable tension rolls, across the extrusion slot lead-on edge and through the rolling pressure nip of the press roll and rod on the lead-off edge, as the roll and rod are rotated at predetermined speeds by motor means.

The coating emitted from the slot is supplied by pump means which meters exactly the quantity of high viscosity coating required to apply a coating of uniform predetermined thickness. There is no exhaust, or discharge aperture for removing excess coating as in the above mentioned Biorseth patent and the rod is deeply seated in its groove with only about the upper quarter of its volume exposed. It has been found that despite its rotation on its longitudinal central axis the rod can be slightly distorted by threaded sections of the seat to compensate for any uneven thickness in the coating. The rod may be continuously rotated at 9–12 r.p.m. to spread wear and free any particles lodged in the nip or it can be normally stationary and only rotated selectively to clear up any streaking in the coating and to present new surfaces for exposure to wear.

DESCRIPTION OF A PREFERRED EMBODIMENT

Figure 1:
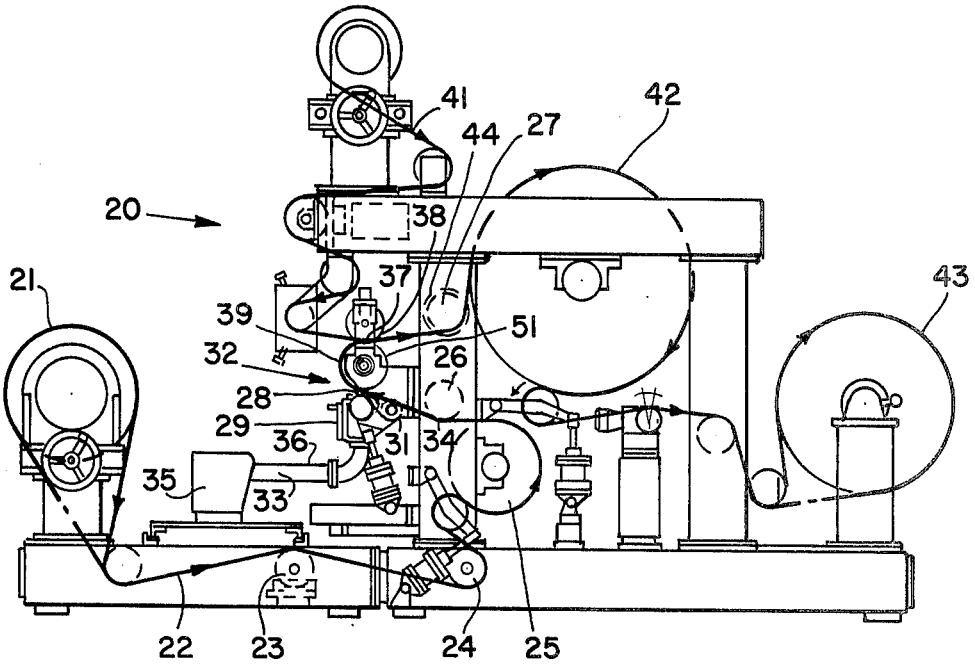
FIG. 1 is a schematic side elevation of a typical extrusion slot coater with the invention installed thereon.

A typical extrusion coater 20 is shown in FIG. 1 of the type disclosed in the above mentioned U.S. Pat. No. 3,854,441 to Park and in U.S. Pat. No. 3,919,974 to Herzog of 1975. The coater 20 is shown schematically and includes an unwind roll 21, for the web 22, which is trained over the tension indicator roll 23, idler rolls 24 and preferably around a pre-heat drum 25. The web 22 is longitudinally tensioned by rolls 26 and 27 as it is advanced over the elongated slot 28 of elongated coating head 29 and one or more of the rolls is a bowed roll 31 for exerting lateral tension on the web in the coating zone 32. A supply of hot melt, or other viscous coating, 33 is supplied to head 29 at a predetermined pressure and a predetermined rate to meter the exact amount of coating desired to produce a particular coating thickness on the underface 34 of the advancing web 22. The supply means includes a suitable motorized pump 35, which feeds conduit 36.

After the application of a thin, layer of coating of uniform thickness on the underface 34 of web 22, the web is advanced through the nip 37 of combining rolls 38 and 39, for lamination with another web 41.

The superposed webs then are trained around a large diameter chill roll 42 and travel then to the wind-up roll 43. A positive variable speed drive 44 is provided between the laminating station 37 and the chill roll 42.

Figure 2:
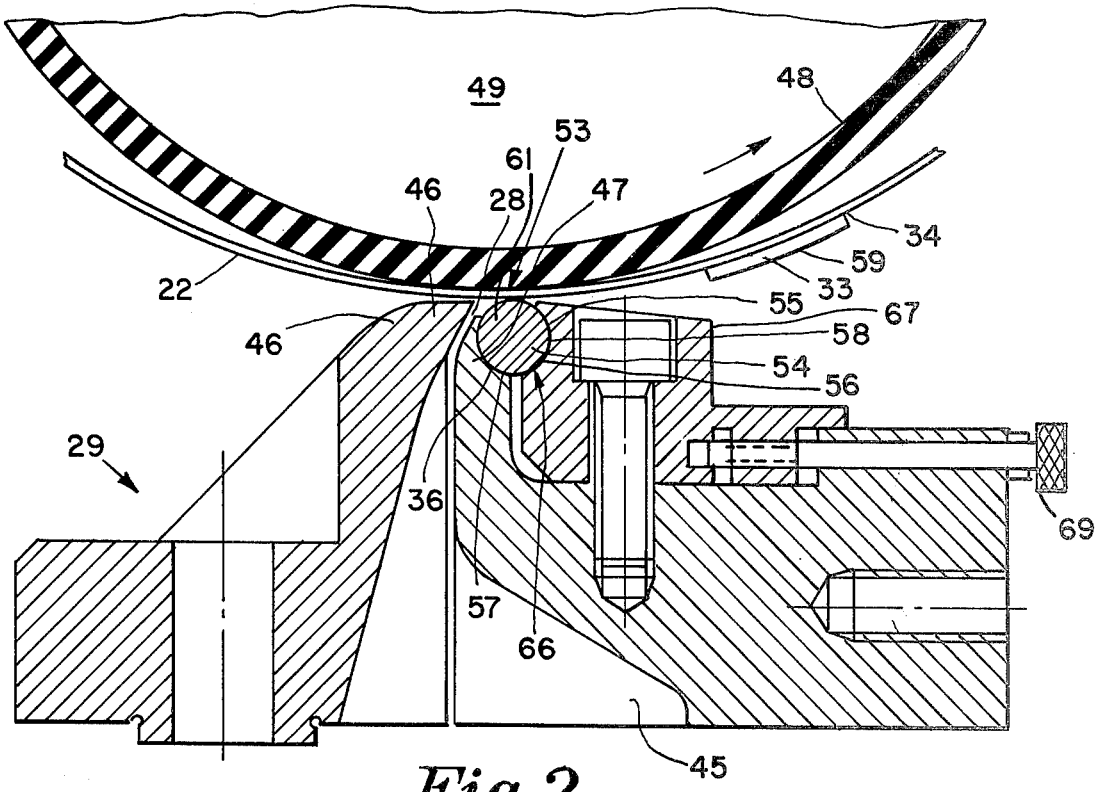
FIG. 2 is an enlarged fragmentary side elevation of the coating head, press roll, rotating rod and rotating rod seat of the invention.
Figure 3:
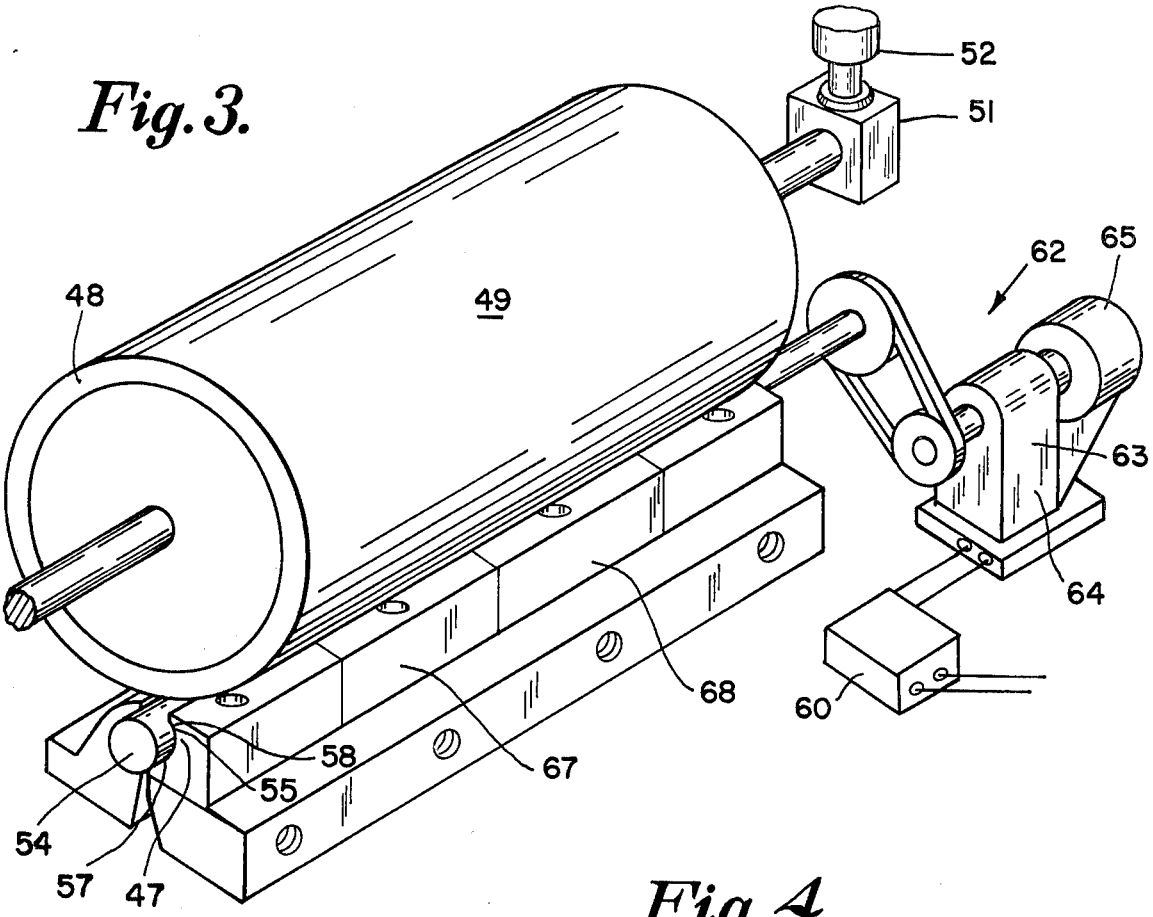
FIG. 3 is a perspective, schematic view showing the press roll, rod, pressure nip and the power drive and control for the rod.
Figure 4:
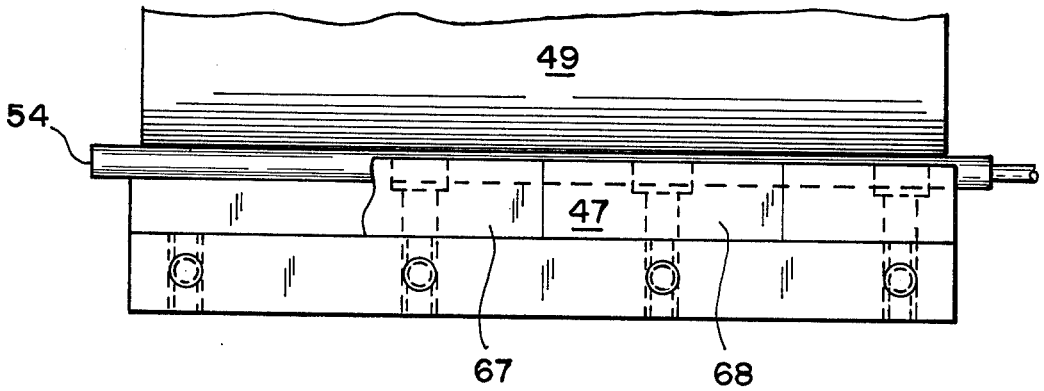
FIG. 4 is a fragmentary rear elevation partly in section showing the threadedly movable sections of the lead-off lip which may be used to distort the rod slightly.

As best shown on a larger scale in FIG. 2 the elongated coating head 29 has a chamber 45 connected to conduit 36 so that the viscous, hot melt, coating 33 is pumped thereinto by the motorized pump 35 for extrusion through the elongated, narrow, extrusion slot 28 formed by the lead-on lip, or edge, 46 and the lead-off lip, or edge, 47. The web 22 is trained under the rubber like resilient surface 48 of the press roll 49, the roll bearings 51 being supported by pistons of air cylinders 52 to exert a predetermined pressure while also yieldable.

Cooperable with the resilient surface 48 of press roll 49 and forming a press roll nip 53 therewith is an elongated cylindrical rod 54 preferably having a hard smooth surface 55, the rod being rotatably seated for its major volume 56 in a groove 57 of substantially cylindrical cross-section in the adjacent surface 58 of lead-off lip 47.

The rod 54 is unyieldably mounted in its groove so that the pump pressure and rate causes a layer 59 of coating 33 to be applied to the underface 34 of web 22 as it is advanced under predetermined longitudinal and lateral tension from lead-on edge 46 to the curved hard face 55 of the rotating rod 54, the rod performing no metering function because revolved at relatively slow speed such as 9–12 r.p.m. while the press roll and web advance at a considerably higher speed per minute.

The minor portion 61 of the rod 54 extends slightly outside of the groove 57 and is exposed. Rod 54 is connected by a suitable power tram 62 through reduction gearing 63 and variable speed control 64 to an electric motor 65. Control means 60 is provided to permit the rod 54 to normally be halted and only selectively and temporarily rotated in the direction of advance of the web when foreign particles have lodged in the press roll nip 53 and are causing streaks in the applied coating. Such rotation frees the particles and eliminates the streaks.

It has been found, however, that highly viscous hot melt coating causes considerable wear on the lead-off surface 55 of the lead-off lip of slot type extrusion coaters and that even when a rod 54 is seated in a groove 57, but not rotated and is of special wear resistant material or treatment, the rod surface tends to wear unevenly and create uneven thickness areas in the coating. Therefore, it is preferred that control means 60 be so adjusted that the rod 54 be continuously rotated at slow speed to spread out the wear and avoid formation of flat spots, or other causes of eccentricity.

While one would expect that an elongated cylindrical rod of small diameter such as rod 54, deeply seated in a groove of corresponding configuration would have to have a rectilinear axis or it would not revolve in the groove, it has been found that one side 66 of the rod seat can be in sections, 67, 68, etc. each with a threaded element 69, the sections being adjustable to slightly distort the rod and its groove to compensate for any uneven thickness in areas transversely of the web.

The threadedly movable side sections, 67, 68, etc. may all be withdrawn to permit substitution of a new rod 54, and if such is not desired, or practical the rods 54 may be slid endwise out of their grooves for easy replacement.

I claim:

1. An extrusion coater of the type having an elongated coating head with an elongated extrusion slot defined by a lead-on lip and a lead-off lip, tension roll means for advancing a web under predetermined tension across said slot from said lead-on lip to said lead-off lip, an elongated rod rotatably supported in a groove in said lead-off lip and forming a pressure nip with the adjacent surface of a press roll, characterized by;

said elongated rod having a smooth hard surface and being unyieldably supported in said groove in said lead-off edge to rotate on a fixed axis of rotation;

said lead-off lip being formed with one fixed, rigid section, and another rigid, section slidably movable in a direction normal to the axis of said rod said sections jointly forming a deep unyieldable seat for said rod with a minor portion of the surface thereof exposed and a major portion of the surface unexposed and within said groove;

threaded mechanism for affixing said slidable section to the other section;

a resilient surface on said press roll and means mounting said press roll for exerting a yieldable, predetermined pressure at said pressure nip with the hard, unyieldable surface of said rod;

pump means for metering the thickness of coating applied to said web by said coating head, and power means including control means, operably connected to said rod for selectively rotating said rod in said deep groove at predetermined speeds at selected times for dislodging foreign material caught in said nip and for spreading wear on said lead-off lip.

2. An extrusion coater as specified in claim 1 wherein;

said power means includes variable speed control means for rotating said rod at selected speeds.

3. Apparatus for coating a moving web, said apparatus comprising:

a stationary coating head having an elongated, narrow, extrusion slot with a lead-on lip and a lead-off lip over which said web is advanced under tension, said lead-off lip being of rigid, inflexible material and unyieldably mounted;

said lead-off lip having a deep, generally cylindrical, elongated groove extending axially therealong, and substantially more than semi-circular in cross section;

an elongated, solid cylindrical rod, having a smooth hard surface, with about two thirds of the volume thereof seated within, and rotatable within, said groove and about one quarter of said surface exposed; said rod being normally stationary and unyieldable;

a press roll having a resilient surface and arranged to apply a predetermined, yieldable pressure at a coating nip formed with the hard, unyieldable surface of said rod variable speed control means for rotating said rod at selected times and at selected speeds pump means for metering the thickness of coating applied to said web at said coating nip, and said lead-off lip comprising a pair of sections, one fixed and the other slidably movable relative thereto in a direction radial to said cylindrical rod and threaded means for affixing said movable section at a predetermined location relative to said fixed section.

4. An extrusion coater of the type having an elongated coating head with an elongated extrusion slot defined by a lead-on lip and a lead-off lip, tension roll means for advancing a web under predetermined tension across said slot from said lead-on lip to said lead-off lip, an elongated rod rotatably supported in a groove in said lead-off lip and forming a pressure nip with the adjacent surface of a press roll, characterized by;

said elongated rod having a smooth hard surface and being unyieldably suppoted in said groove in said lead-off edge to rotate on a fixed axis of rotation;

said lead-off lip being formed with one fixed, rigid section, and another movable, rigid, section, slidably movable in a direction normal to the axis of said rod, said sections jointly forming a deep seat for said rod with a minor portion of the surface thereof exposed and a major portion of the surface unexposed and within said groove;

a resilient surface on said press roll and means mounting said press roll for exerting a yieldable, predetermined pressure at said pressure nip with the hard, unyieldable surface of said rod;

pump means for metering the thickness of coating applied to said web by said coating head, power means including control means, operably connected to said rod for selectively rotating said rod in said deep groove at predetermined speeds, at selected times for dislodging foreign material caught in said nip and for spreading wear on said lead-off lip, said lead-off lip including a plurality of said movable sections extending therealong and jointly forming one side of said deep seat for said rod.

and a plurality of individual threaded means each for moving one of said movable sections relative to said fixed rigid section to slightly distort said rod in desired locations therealong while still permitting rotation of said rod in said groove.

* * * * *